United States Patent [19]

Lee

[11] Patent Number: 4,623,409

[45] Date of Patent: Nov. 18, 1986

[54] PREPARATION OF 1,1'-DINITRO-3,3'-AZO-1,2,4-TRIAZOLE

[75] Inventor: Kien-Yin Lee, Los Alamos, N. Mex.

[73] Assignee: The United States of America as represented by the Department of Energy, Washington, D.C.

[21] Appl. No.: 708,624

[22] Filed: Mar. 5, 1985

[51] Int. Cl.[4] ..... C06B 25/34

[52] U.S. Cl. ..... 149/92; 534/765; 260/688

[58] Field of Search ..... 534/765; 149/92; 260/688

[56] References Cited

PUBLICATIONS

Chemical Abstracts, "Heterocyclic Nitro Compounds", vol. 92, No. 6474d (1980) p. 610.

Chemical Abstracts, "Azotriazoles and Azotetrazoles as Antifogging & Antispotting Agents & Selective Desensitizers in Photographic Silver Halide Emulsions, Baths & Film", vol. 78, No. 130578r (1978), p. 433.

*Primary Examiner*—Stephen J. Lechert, Jr.

*Assistant Examiner*—Anne Brookes

*Attorney, Agent, or Firm*—Samuel M. Freund; Judson R. Hightower

[57] ABSTRACT

A new high density composition of matter, 1,1'-dinitro-3,3'-azo-1,2,4-triazole, has been synthesized using inexpensive, commonly available compounds. This compound has been found to be an explosive, and its use as a propellant is anticipated.

11 Claims, 1 Drawing Figure

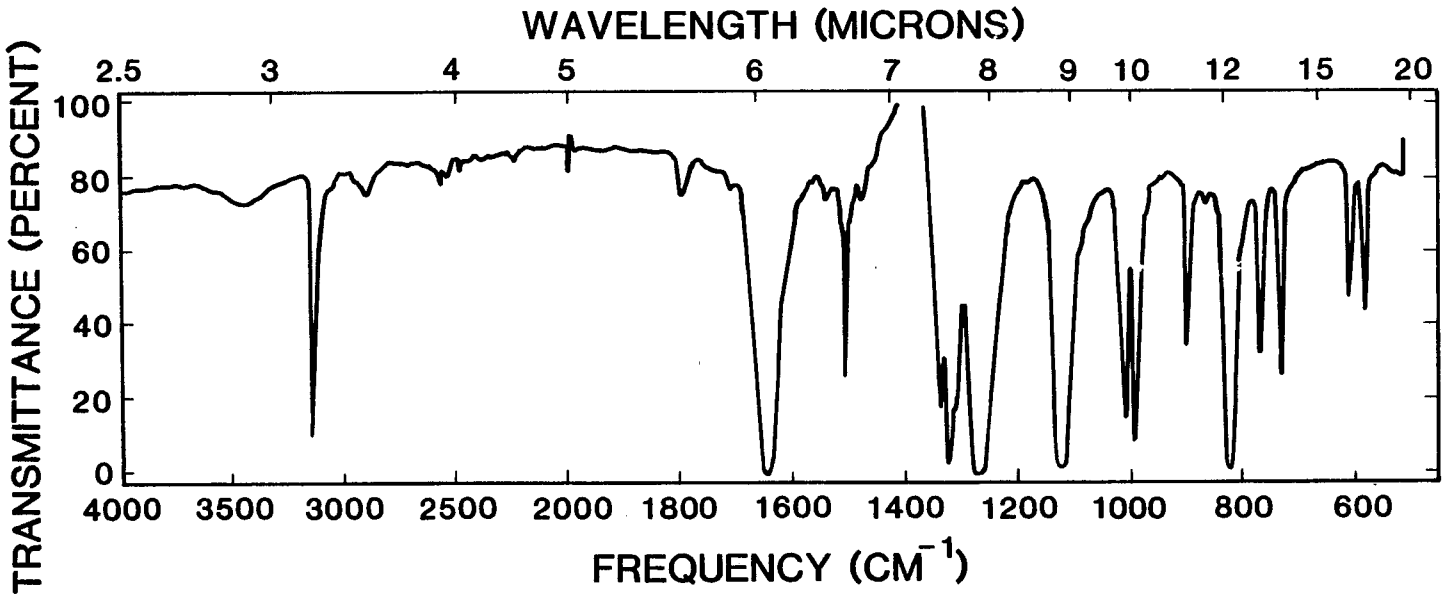
FIGURE

PREPARATION OF 1,1'-DINITRO-3,3'-AZO-1,2,4-TRIAZOLE

This invention is the result of a contract with the Department of Energy (Contract No. W-7405-ENG-36).

BACKGROUND OF THE INVENTION

The present invention relates in general to explosives, and more particularly to preparation of 1,1'-dinitro-3,3'-azo-1,2,4-triazole and its use as an explosive composition.

The search for novel explosive compositions having interesting properties continues to be of interest in the area of military and conventional weapons applications. Consequently, a new high density, explosive compound, which is a candidate for high-energy propellant applications, has been safely prepared from inexpensive starting materials.

SUMMARY OF THE INVENTION

Accordingly, it is an object of the present invention to introduce a new explosive composition of matter.

Another object of my invention is to prepare a new composition of matter from inexpensive and readily available starting materials.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the composition of matter hereof includes 1,1'-dinitro-3,3'-azo-1,2,4,-triazole.

In a further aspect of the present invention, in accordance with its objects and purposes, the preparation hereof includes oxidation of 3-amino-1,2,4-triazole starting material to form 3,3'-azo-1,2,4-triazole intermediate nitrating the 3,3'-azo-1,2,4-triazole to form the desired 1,1'-dinitro-3,3'-azo-1,2,4-triazole product, and extracting the product. It is preferred that the oxidation step be performed using potassium permanganate, and that the nitration step be performed using acetyl nitrate.

Benefits and advantages of the present invention include the safe preparation of a high density explosive from inexpensive and readily available starting materials.

BRIEF DESCRIPTION OF THE DRAWING

The accompanying FIGURE, which is incorporated in and forms a part of the specification, shows an infrared spectrum of the 1,1'-dinitro-3,3'-azo-1,2,4,-triazole product of the subject invention.

DETAILED DESCRIPTION OF THE INVENTION

Reference will now be made in detail to the present preferred embodiments of the invention. The preparation of 1,1'-dinitro-3,3'-azo-1,2,4-triazole is achieved in two principal steps: an oxidation of 3-amino-1,2,4-triazole starting material to form the intermediate 3,3'-azo-1,2,4-triazole, followed by a nitration of the intermediate to form the product.

I. The intermediate, 3,3'-azo-1,2,4-triazole, is prepared from 3-amino-1,2,4-triazole, a commonly available and inexpensive weed killer as follows:

The 3,3'-azo-1,2,4-triazole may be prepared by oxidation of 3-amino-1,2,4-triazole with potassium permanganate ($KMnO_4$) according to the procedure described in "Ueber Derivate des Triazols," by Thiele and Machot, Ann. Chem. 303, pp 47–49 (1898), the disclosure of which is hereby incorporated by reference herein. Thus, $KMnO_4$ (10.59 g, 0.06 mol) is added gradually and with cooling to a solution of 3-amino-1,2,4-triazole (8.4 g, 0.1 mol) in NaOH (2N). After complete dissolution, the reacting mixture is heated to about 60° C. and additional $KMnO_4$ is added until the solution remains green. After reduction of the excess $KMnO_4$ with sodium bisulfite solution, the mixture is filtered and the 3,3'-azo-1,2,4-triazole product is obtained as a yellowish precipitate by the addition of concentrated HCl to the hot filtrate. After washing with water and acetone, the 3,3'-azo-1,2,4-triazole is dried under high vacuum before use. Its purity was verified by NMR spectroscopy.

II. The 1,1'-dinitro-3,3'-azo-1,2,4-triazole final product can be prepared by either the addition of the intermediate product, 3,3-azo-1,2,4-triazole, to a mixture of nitric acid and acetic anhydride, or by the addition of acetic anhydride to a solution of the intermediate product in nitric acid. The former procedure will now be described in detail. 0.6 g or 0.00037 mol of the intermediate product is slowly added to a mixture of 100% nitric acid (2.1 cc, 0.05 mol) and acetic anhydride (4.7 cc, 0.05 mol) at 0° C. After stirring for about 1 hour with the mixture kept at approximately 6° C., the reaction mixture is poured into ice water and allowed to remain at about 0° C. for approximately 12 hours. The solid obtained thereby is the desired product and is washed with water and recrystallized from acetone. The yield for this reaction is about 40%.

The overall reaction is illustrated in the following equation.

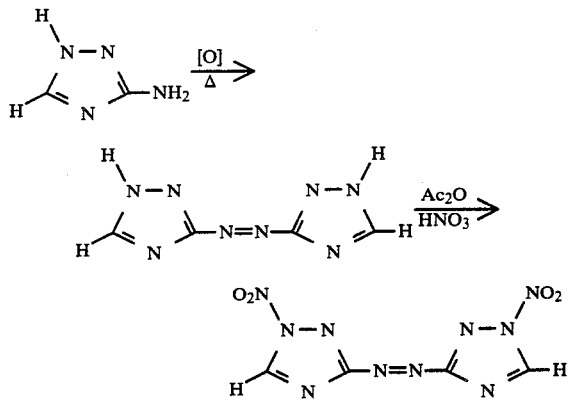

The structure of the 1,1'-dinitro-3,3'-azo-1,2,4-triazole was identified using infrared and NMR spectroscopy. The infrared spectrum is shown in the accompanying FIGURE. Both proton and carbon NMR demonstrate that this molecule is symmetrical, and the magnitude of the proton chemical shift indicates that the proton is in the α position relative to the nitro group. The chemical shift of the CH proton and the carbon-13 chemical shifts for the CH and C—N carbons are 9.99 ppm, 143 ppm, and 163 ppm, respectively. The 1,1'-dinitro-3,3'-azo-1,2,4-triazole is a yellowish crystalline solid which is insoluble in water, but soluble in most organic solvents for which solubility tests were conducted; e.g., acetone and acetonitrile to identify two in which the composition of the present invention is soluble. It is also quite sensitive to impact (approximately 11 cm by Type 12 drop-weight impact machine), and burns swiftly in the flame test. Other measured physical and chemical properties of this compound are shown in the accompanying Table.

TABLE

| | |
|---|---|
| Molecular Weight: | 254 |
| Density (g/cm$^3$): | 1.808 (calc.)<br>1.77 (flotation method) |
| DTA (°C.): | Decompose around 130° C. without melting |
| $\Delta H_f$(kCal/mole) | +94.4 (Calc.) |

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What I claim is:

1. A propellant composition which comprises 1,1'-dinitro-3,3'-azo-1,2,4-triazole.

2. An explosive composition which comprises 1,1'-dinitro-3,3'-azo-1,2,4-triazole.

3. A method of preparation for 1,1'-dinitro-3,3'-azo-1,2,4-triazole, said preparation comprising the steps of:

a. oxidation of 3-amino-1,2,4-triazole starting material to form 3,3'-azo-1,2,4-triazole intermediate;

b. nitrating said 3,3'-azo-1,2,4-triazole; and c. extracting the product.

4. The method as described in claim 3, wherein said oxidation step is performed by addition of potassium permanganate to a first solution of the 3-amino-1,2,4-triazole in sodium hydroxide solution until the solution turns green forming thereby a second solution.

5. The method as described in claim 4, wherein the excess potassium permanganate in the second solution is reduced with sodium bisulfite, forming thereby a third solution, and wherein the 3,3'-azo-1,2,4-triazole intermediate is obtained as a precipitate by the addition of concentrated hydrochloric acid to the third solution.

6. The method as described in claims 3 or 5, wherein said nitration step is performed using acetyl nitrate.

7. The method as described in claims 3 or 5, wherein said nitration step is performed by the addition of the 3,3'-azo-1,2,4-triazole intermediate to a mixture of acetic anhydride and nitric acid, forming thereby a fourth solution, and wherein the fourth solution is mixed with ice water, thereby causing the 1,1'-dinitro-3,3'-azo-1,2,4-triazole product to precipitate.

8. The method as described in claims 3 or 5, wherein said nitration step is performed by the addition of acetic anhydride to a solution of the 3,3'-azo-1,2,4-triazole in nitric acid.

9. A composition of matter which comprises 1,1'-dinitro-3,3'-azo-1,2,4-triazole.

10. A composition of matter which consists essentially of 1,1'-dinitro-3,3'-azo-1,2,4-triazole.

11. An explosive composition which consists essentially of 1,1'-dinitro-3,3'-azo-1,2,4-triazole.

* * * * *